US005730333A

United States Patent [19]

Baluk et al.

[11] Patent Number: 5,730,333

[45] Date of Patent: Mar. 24, 1998

[54] RETAIL BULK PRODUCT DISPENSER

[76] Inventors: Raymond Baluk; Freddie Chu, both of 4620 W. 19th St., Chicago, Ill. 60650; James Murray; George Mullinix, both of 4120 Jersey Pike, Chattanooga, Tenn. 37421

[21] Appl. No.: 623,871

[22] Filed: Mar. 29, 1996

[51] Int. Cl.[6] ..... B67D 5/06

[52] U.S. Cl. ..... 222/181.3; 222/561

[58] Field of Search ..... 222/181.1, 181.3, 222/185.1, 511, 561

[56] References Cited

U.S. PATENT DOCUMENTS 4,562,941 1/1986 Sanfilippo ..... 222/181.1 X 5,529,219 6/1996 Ward ..... 222/181.1 X 5,560,519 10/1996 Moore et al. ..... 222/185.1 X

*Primary Examiner*—Gregory L. Huson

*Attorney, Agent, or Firm*—Miller & Martin

[57] ABSTRACT

This invention discloses a retail bulk product dispenser for solid, compact food products having rough, texturized or sticky surfaces such as bite-sized chocolates having a spring loaded, hand operable gate and a pressure relieving baffle which prevents bin arching. An opening is provided in the gate in a manner to prevent the formation of ledges which might impede the flow of products.

20 Claims, 4 Drawing Sheets

RETAIL BULK PRODUCT DISPENSER

BACKGROUND OF THE INVENTION

The present invention pertains to retail bulk product dispensers for solid, compact food products having rough, texturized or sticky surfaces such as bite-size chocolates. More specifically, there is disclosed a gravity activated dispenser of unwrapped chocolate candy products with a spring loaded, hand operable gate and a pressure relieving baffle which prevents bin hangups or arching.

The use of retail bulk product dispensers is well known. For example, dispensers are often found on the coffee aisles of grocery stores which allow the consumer to operate a dispensing mechanism and feed bulk coffee beans from a storage bin into a package sized to the consumer's desire.

Several considerations drive the design of such dispensers. First, it is imperative that the product being dispensed not form a bridge or arch within the dispenser which impedes or cues off the flow of product into the receptacle. Furthermore, if and when the arch collapses, the product may surge from the dispenser, possibly delivering unwanted quantities of product which overfill or overflow the receptacle or are otherwise wasted.

It is well known that increasing the size of the outlet at the bottom of the dispenser can decrease the likelihood of arching. Increasing the size of the outlet also increases the rate of product flow. But, as the size of the product increases, the likelihood of arching also increases. Product shape can also inhibit or exacerbate arching. Products with few angled edges, such as coffee beans, are less likely to arch than shaped candies with a greater number of angular intersections or irregular surfaces. Likewise, the surface texture of the product being dispensed has a significant influence upon the likelihood of arching. Smooth products, such as coffee beans, slide easily over one another while the friction between products with rougher textured surfaces is greater, increasing the likelihood of arching. If the product is actually tacky or sticky, as chocolate is known to be (especially at higher temperatures), then the arching problem is only further compounded.

Competing considerations regarding the size of the bin and the weight of product must also be considered in the design of a dispenser. It is obviously desirable that the bin which holds the bulk product be as large as practicable in order to reduce the need and expense of constant stocking and restocking and to decrease the chance that the dispenser may run empty, resulting in lost sales. However, as the size of the bin, and, therefore, the weight of the product in the bin, increases, the pressure between underlaying pieces of product also increases, leading to greater friction and more frequent arching. Added weight also makes for larger and more forceful surges of product when an arch breaks.

In the art, a closeable outlet is typically situated at the bottom of the bin which, when opened, allows the force of gravity to pull product through the outlet into the waiting receptacle. As previously stated, the size of the outlet is directly related to the likelihood of arching, with larger outlets resulting in less arching. However, in addition to the size of the outlet, the absence or presence of angled edges on the outlet also influences the rate of arching. Where the outlet has edges over which the product must pass, the edges themselves are surfaces against which arching can occur. Therefore, the fewer protruding angles, or the smaller the angle with respect to the downward flow of product, the less the likelihood of arching.

Finally, the sides and floor of the dispenser must be steep enough so that the product will slide smoothly along those surfaces during dispensing. If the walls or floor are not steep enough, a layer of product can build up, restricting the area from which product can flow to the dispenser outlet. This condition is known as "rat-holing".

The dispensing of chocolate candy products or candies entails each of the problems discussed above. These candies are relatively large compared to bulk products typically dispensed through consumer operated dispensers and vary considerably in shape, having many irregular faces. Such candies are also typically more sticky or tacky as compared to other dispensed products. Furthermore, when compressed together under the pressure of additional product, candies may even become stuck or fused together, forming substantially larger pieces which are more likely to cause arching. Chocolate candies are also typically softer than other dispensed products such as coffee beans and therefore may be more easily indented or cut by protruding edges and thereby caught within the outlet, forming arches.

The present invention is responsive to each of these considerations and results in a bulk candy dispenser which eliminates arching.

SUMMARY OF THE INVENTION

In the present invention, the limitations associated with dispensing bulk chocolate products are overcome by a novel design incorporating a pressure relieving baffle within the interior of the dispenser bin and utilization of an "edgeless" outlet.

It is, therefore, an object of the present invention to provide a bulk product dispenser which eliminates arching.

It is further object of the present invention to provide a bulk product dispenser which has a significant storage capacity without the concomitant propensity for arching.

These and other object, advantages and applications of the present invention will become apparent to those skilled in the art when the accompanying description of the preferred embodiment of the present invention is read in conjunction with the accompanying drawings.

DETAILED DESCRIPTION OF THE DRAWINGS

Figure 1:
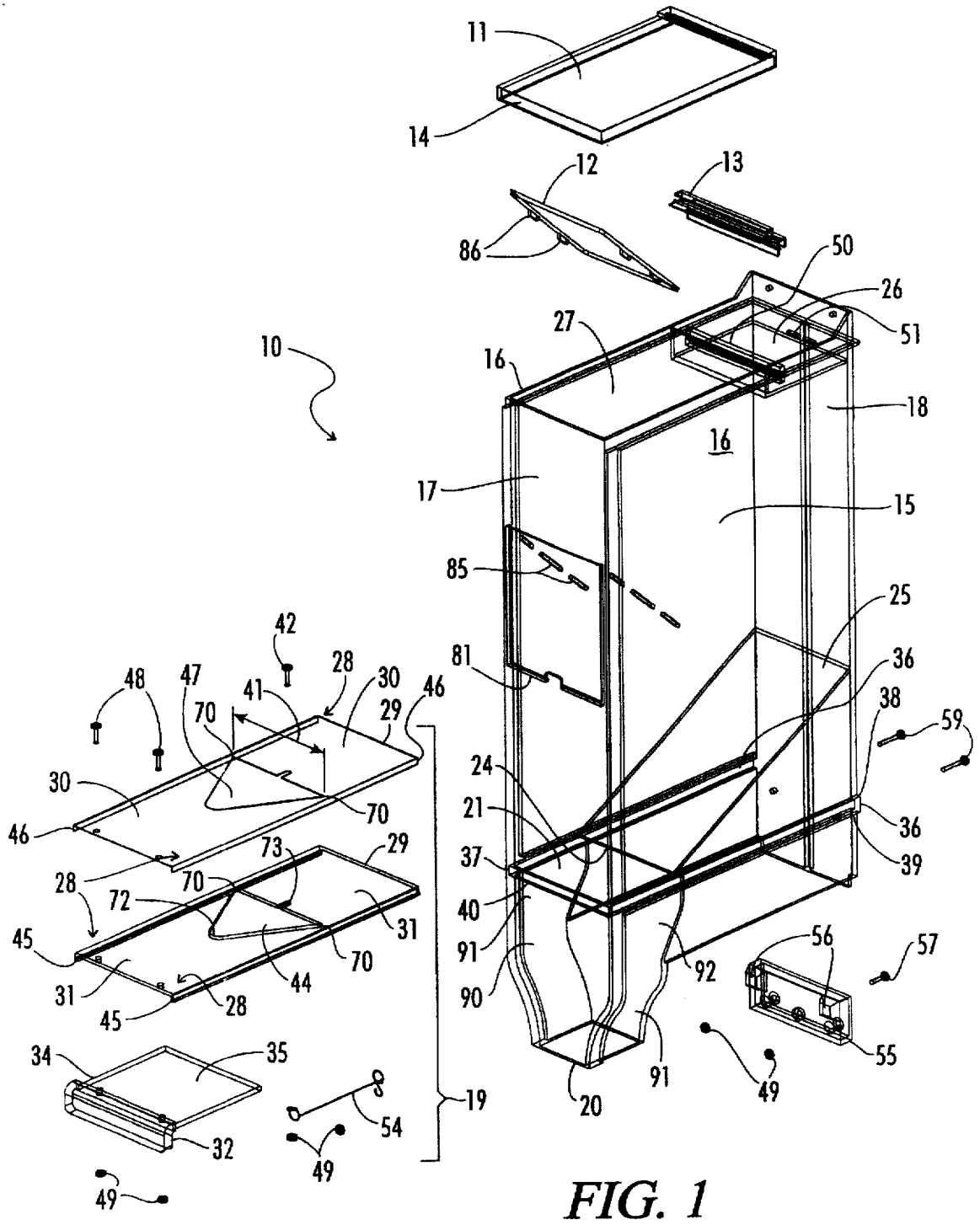
FIG. 1 is an exploded perspective view of a preferred embodiment of the retail bulk product dispenser.

Referring now to the drawings and in particular to FIG. 1, an exploded perspective view of a preferred embodiment of the bulk product dispenser 10 is shown. The dispenser 10 comprises primarily a product storage area or bin 15 with an outlet 21, and a hand operated dispensing mechanism, such as gate 19 slidably moveable between a normal, closed position and an open dispensing position (shown disassembled in FIG. 1 as its component parts: reinforcing plate 30, plastic plate 31, and handle unit 34). The size, shape and capacity of the bin 15 may vary as desired, depending upon such factors as available space, rate of product consumption or in-store arrangement and display. However, in any configuration, it is necessary that the floor 25 of the bin 15 (or the walls if a conical or otherwise curved surface (not shown) is utilized) is sufficiently steep to allow product (not shown) to slide towards the outlet 21 when the outlet 21 is opened. This avoids rat-holing. Typically, the upward angle θ of the floor (shown in FIG. 2) ranges between 25° and 50° and is preferably about 30° when the bin is to be filled with products similar to chocolate candy.

Returning to FIG. 1, in a preferred embodiment of the present invention, the bin 15 is comprised of a front wall 17, an opposing rear wall 18, at least two side walls 16 connecting the front wall 17 and the opposing wall 18, a floor 25, an outlet 21, and a top which consists of a superior opening 27, and a superior fluid receptacle, such as well 26. A parallel pair of facing transverse grooves 36 in the opposing side walls 16 flank the outlet 21. These grooves 36 are sized to accommodate the runners 23 of the gate 19 (shown in FIG. 3), forming a track within which the gate 19 is able to slide forward and back. A slot 37 in the front wall 17 is aligned with the grooves 36 through which the gate 19 can pass. This slot 37 is sized to closely accommodate the gate 19 on all sides and thereby prevent product (not shown) from escaping.

Figure 2:
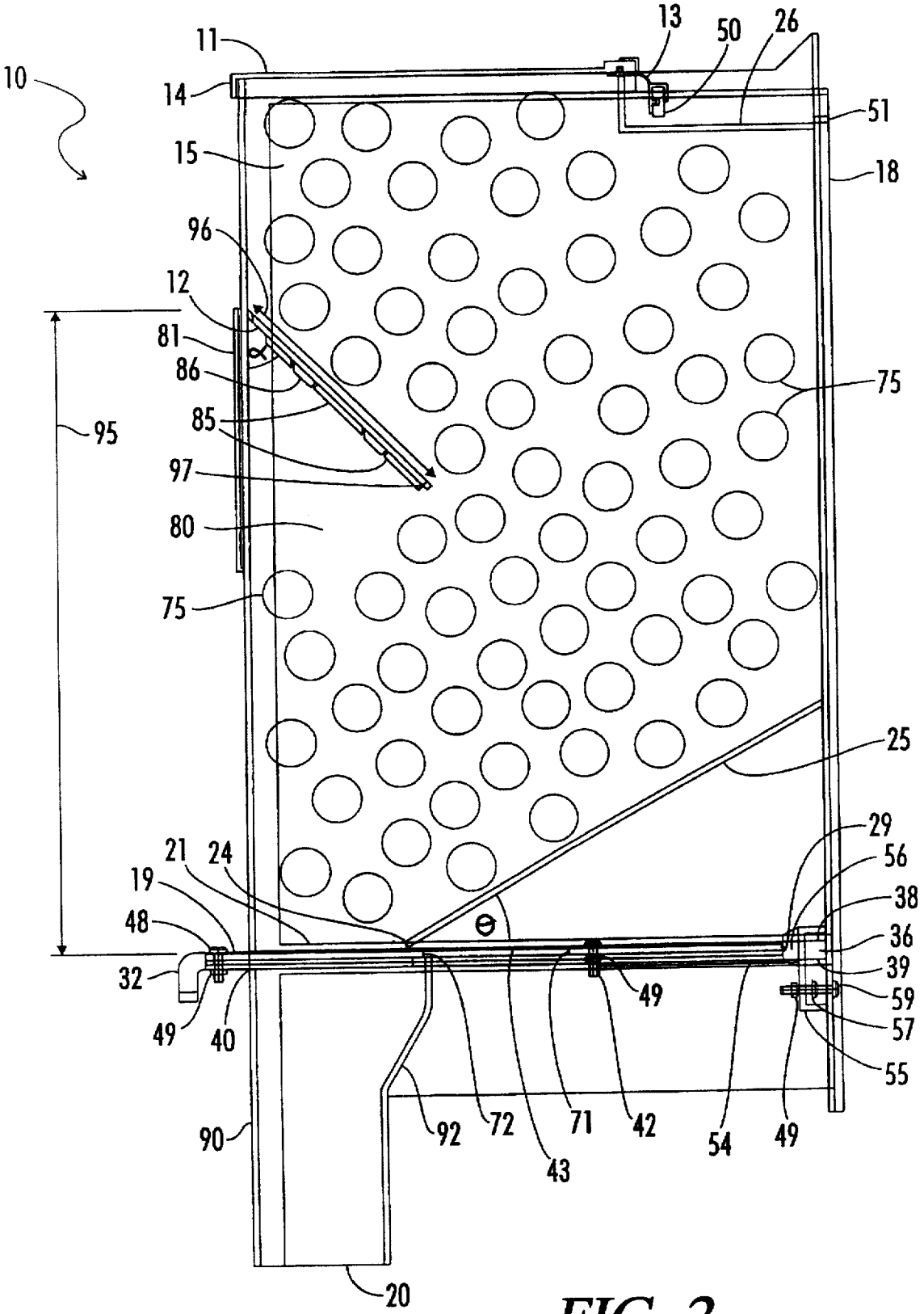
FIG. 2 is a side cross sectional view of a preferred embodiment of the retail bulk product dispenser with the gate in the normal, closed position.

The inferior end 24 of the sloped floor 25 is positioned flush with the top edges 38 of the grooves 36, but the floor 25 does not span the entire bin 15 from the opposing wall 18 to front wall 17, instead, a lower opening or outlet 21 is formed which is blocked by the gate 19 when the gate 19 is in the normal, closed position (as illustrated in FIG. 2).

A funnel or spout 20 is positioned under the outlet 21. The front 90 of the spout 20 is positioned flush with the lower edge 40 of slot 37 and the sides 91 of the spout 20 are positioned flush with the lower edges 39 of the grooves 36. This arrangement provides a relatively smooth and uniform transition from the bin 15 through the outlet 21 to the spout 20, the only discontinuities being the grooves 36 and the slot 37. Furthermore, as explained in greater detail below, these discontinuities are further mitigated by the design of the gate 19.

As shown in FIG. 2, the rear side 92 of the spout 20 is offset rearwardly from the inferior end 24 of the floor 25 such that the floor 25 overhangs the rear side of the spout 92. The rear side 92 of the spout 20 extends above the lower edges 39 of the grooves 36 such that it loosely contacts the gate 19. As explained below in connection with the gate 19, this positioning of the rear side 92 of the spout 20 is a functional feature of the present invention which serves, in conjunction with the stopper screw 42, to limit the range of motion of the gate 19.

As shown in FIGS. 1 and 2, the superior opening 27 of the bin 15 is covered with a lid 11 having an overlapping rim 14, designed in accordance with National Sanitation Foundation ("NSF") standards, which, when closed (as shown in FIG. 2), forms a seal sufficient to prevent any liquid spilled on top of the dispenser 10 from penetrating the bin 15. The lid 11 is joined to the dispenser 10 by a hinge, such as living hinge 13. In the preferred embodiment of the present invention, the living hinge 13 is fabricated from a dual durometer plastic and is affixed to the dispenser at a crosspiece 50 which is joined to both side walls 16 external to the bin 15 but recessed within the well 26.

The well 26 is another feature of the present invention which is designed to meet NSF standards and is intended to serve as a collection point for any liquids which might be spilled upon the top of the dispenser 10. The well 26 has one or more drains 51. In the preferred embodiment, the drains 51 are positioned in the opposing rear wall 18 of the dispenser in order to channel any collected liquid down the back of the dispenser 10, away from the view of consumers. However, drains 51 could also be positioned in the side walls 16 or even in the bottom (not numbered) of the well, as long as the integrity of the bin 15 is not compromised.

Figure 3:
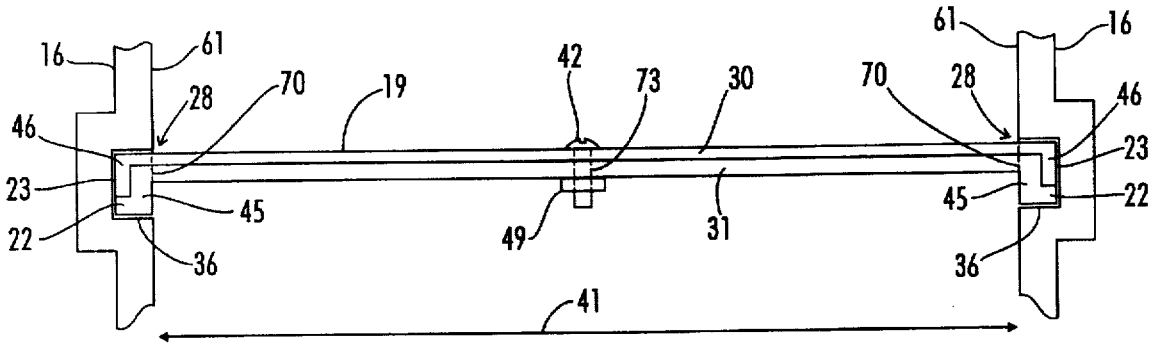
FIG. 3 is a front cross sectional view of the gate and grooves of the retail bulk product dispenser shown in FIG. 2.

As shown in FIG. 3, the gate 19 has a pair of runners 23 disposed on lateral opposing sides 28 of the gate 19 which are sized to fit within the grooves 36. As shown in FIG. 2, the gate 19 also comprises a forward handle 32, a rear end 29, and a medial opening 43. In a preferred embodiment of the present invention shown in FIG. 1, the gate 19 is comprised of a plastic plate 31, a thinner reinforcing plate 30, and a handle unit 34. The plastic plate 31 has downwardly extending flanges 45 with outwardly extending leg portions 22 on each lateral side 28 which, when joined with the corresponding and meshing downwardly extending flanges 46 of the reinforcing plate 30, form the runners 23 of the gate 19. The reinforcing plate 30 and plastic plate 31 have substantially similar dimensions and each has a substantially similarly sized central opening (47 and 44 respectively) located such that the central openings 44 and 47 aline to form the medial opening 43 of the gate 19 when reinforcing plate 30 is joined to plastic plate 31 and handle unit 34 with fasteners, such as gate screws 48, stopper screw 42 and their respective nuts 49. In the preferred embodiment, the central opening 47 of the reinforcing plate 30 is slightly larger than the central opening 44 of the plastic plate 31 for safety purposes (i.e., to ensure that any protruding edge is plastic rather than thin steel which could injure fingers inserted into the opening).

As illustrated in FIG. 3, the outwardly extending leg portions 22 of the flanges 45 of the plastic plate 31 are at least of a length equal to the thickness of reinforcing plate 30, and engage with the meshing flanges 46 of the reinforcing plate such that uniform runners 23 are formed by joining plates 30 and 31. Runners 23 are sized to travel smoothly within each respective groove 36.

Figure 4:
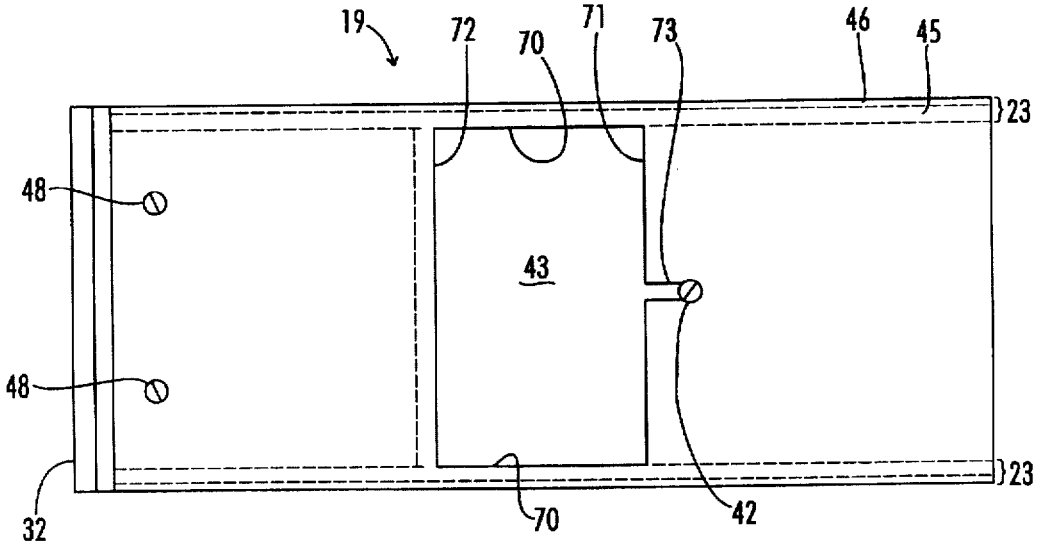
FIG. 4 is a top view of a preferred embodiment of the gate of the retail bulk product dispenser.
Figure 5:
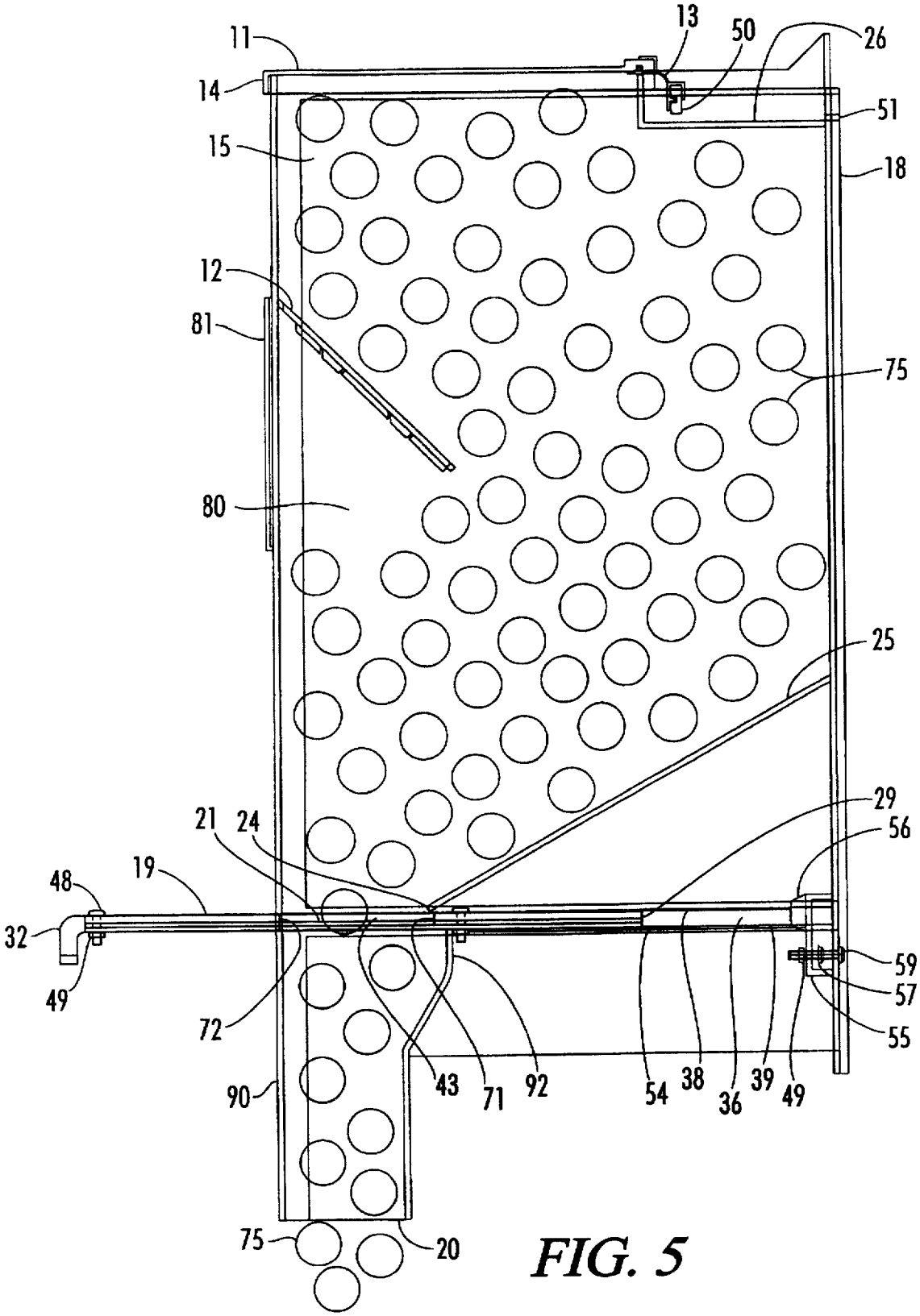
FIG. 5 is a side cross sectional view of a preferred embodiment of the retail bulk product dispenser with the gate in the open position.

As shown in FIG. 4, the width 41 of the medial opening 43 of the gate 19 may extend substantially to each opposing runner 23. Since each runner 23 lies within its respective groove 36, the side edges 70 of medial opening 43 are substantially flush with the inner surface 61 of the respective side wall 16 and present no protruding edge upon which product being dispensed can catch to form an arch. Thus it can be seen in FIGS. 2 and 5 that as the gate 19 is pulled forward from its normal, closed position, the leading edge 72 of the medial opening 43 is drawn forward from under the floor 25, gradually unblocking the outlet 21. This, as shown in FIG. 5, allows product 75 to flow through the outlet 21 and spout 20 into a waiting receptacle (not shown). Since the runners 23 on either side of the medial opening 43 are flush with the inner surface 61 of the side walls 16 or recessed within the grooves 36 (as shown in FIG. 3), the product being dispensed through the outlet 21 in FIG. 5 encounters no protruding edges on either side which can promote arching. Additionally, once the gate 19 is pulled forward such that the leading edge 72 of the medial opening 43 is flush with or recessed within the slot 37, another edge which could potentially cause arching is eliminated from the path of the product, thus making the outlet 21 virtually "edgeless." Note that it is this "edgeless" quality which necessitates the reinforcing plate 30 since without it, the runners 23 on either side of the medial opening 43 would be composed entirely of plastic and, without the material strength of the meshing flanges 46 of the reinforcing plate 30, would be susceptible to breaking. To maintain the integrity of the gate, the reinforcing plate 30 is made of a sturdy material suitable for use in contact with food products, such as the preferable stainless steel.

As shown in FIG. 4, in the preferred embodiment of the present invention, the medial opening 43 is shaped like a rectangle. The medial opening 43 may also be given other shapes, such as a substantially triangle shape, shown in FIG. 1. However, such other shapes provide additional protruding edges which may cause arching. However, such other shapes, such as circular openings, may be useful in combination with the baffle 12 (described below) where the products being dispensed are not tacky or are smaller candies.

In the preferred embodiments shown in FIGS. 1 and 2, the handle unit 34 and plates 30 and 31 are joined together outside of the bin 15 by at least one fastener, such as screws 48 and nuts 49. These fasteners connect the pieces of the gate 19 outside the slot 37 so that these fasteners never come into contact with the food product stored within the bin 15. The handle unit 34 also has a shelf 35 which is sized to fit between the flanges 45 of the plastic plate 31 and extends proximate to, but not past, the leading edge 72 of the medial opening 43 when joined to form the gate 19. The shelf 35 is essentially a reinforcing structure which serves to support the handle 32 and to steady the motion of the gate 19 as it moves through the slot 37.

The reinforcing plate 30 and the plastic plate 31 of the gate 19 are further joined together outside of the bin 15 by a first fastener such as stopper screw 42 and nut 49. The stopper screw 42 is inserted into notch 73 which is centrally located on the on the rear edge 71 of the medial opening 43. The notch 73 is sized relative to the amount of overhang between the inferior end 24 of the floor 25 and the rear side 92 of the spout 20 such that when the stopper screw 42 is in place, it acts as a detent when it encounters the raised rear side 92 of the spout 20 as the gate 19 is drawn forward, thereby preventing the rear edge 71 of the medial opening 43 from being pulled out from under the overhanging floor 25. The stopper screw 42 also prevents the gate 19 from being pulled out of the slot 37. Note that the stopper screw 42 is also always positioned external to the bin 15, outlet 21 and spout 20, and thus never comes into contact with the food product being stored or dispensed.

The stopper screw 42 may also serve as the attaching point for a biasing means, such as spring 54, to the gate 19. The spring 54 is also attached to the opposing rear wall 18 of the bin 15 by a second fastener, such as mounting screw 57, thereby providing the requisite force to return and retain the gate 19 in its normal, closed position after the desired product has been dispensed and the handle 32 is released by the consumer.

The biasing means, such as spring 54, must be attached such that its tension is sufficient to close the gate 19 against the flow of product, yet must not be so great that consumers have difficulty manipulating the gate 19. In the preferred embodiment of the present invention, the spring 54 supplies a closing force ranging between approximately 2 and approximately 12 foot pounds of pulling force when the gate 19 is fully opened. The pulling force increases as the gate 19 is opened and the initial closing force when the gate is in its closed position may be as little as 2 foot pounds. The impact of the gate with the opposing rear wall upon its return to the normal, closed position may be softened by one or more rubber bumpers 56 positioned between the gate 19 and the opposing rear wall 18. In the preferred embodiment of the present invention, the spring 54 is attached to the opposing rear wall 18 of the bin 15 at mounting block 55 by means of a mounting screw 57 and nut 49. The mounting block 55, in turn, is affixed to the opposing rear wall 18 of the bin 15 by means of fasteners such as block screws 59 and nuts 49. Bumpers 56 are also adhesively affixed to the mounting block 55.

A final novel aspect of the present invention is a pressure relieving baffle 12 mounted against the front wall 17 in the bin 15 superior to the outlet 21. As shown in FIG. 2, the baffle 12 is mounted at a downward angle $\alpha$ such that the flow of product is diverted towards the opposing rear wall 18 of the bin 15 rather than directly toward the outlet. The angle $\alpha$ of the baffle 12 relative to the direction of the force of gravity typically ranges between 35° and 65°, and for chocolate candies is preferably about 45°. The baffle 12 serves to support the weight of a portion of the stored product 75 (as shown in FIGS. 2 and 5), thereby decreasing the gravitational pressure applied directly downward on the outlet during dispensing. This decrease in pressure decreases the likelihood of arching. The height 95 above the outlet 21 and the length 96 of the baffle 12 may vary depending upon the angle $\alpha$ and the size of the bin 15, but it is preferable that the length 96 of the baffle 12 be such that the outlet 21 is substantially covered by the baffle 12, thereby diverting the direct downward force of all product which may be situated above the baffle 12 from the outlet 21. It has also been found preferable that the baffle 12 be positioned at a height 95 above the outlet 21 such that the flow of product between the inferior end 97 of the baffle 12 and the sloped floor 25 is not impeded by arching between the inferior end 97 of the baffle 12 and the floor 25.

As shown in FIG. 1, in the preferred embodiment, the baffle 12 is removably mounted by a mounting means, such as upon parallel rows of ribs 85 which correspond with coupling ribs 86 on the baffle 12. Other conceivable mounting means may also be used, such as crossbars (not shown), or grooves (not shown).

As shown in FIGS. 2 and 5, when the bin 15 is filled with product 75, the baffle 12 creates a hollow 80 within the bin 15. From an aesthetic standpoint, this hollow 80 presents a dark appearance to consumers whereas it is preferable that the consumers only be able to see the product 75. To avoid this problem, in the preferred embodiment, an appropriately sized shield, such as product insert holder 81, is affixed to the front wall 17 such that the baffle 12 and hollow 80 are blocked from the consumer's view when a product insert (not shown) is placed in the insert holder 81.

Returning then to FIG. 1, all components of the dispenser 10 are constructed of a clear plastic polymer of any of the types approved by the Food and Drug Administration (the FDA) for use in contact with food products, except for the fasteners (screws 42, 48, 57 and 59 and nuts 49), hinge 13, reinforcing plate 30, spring 54 and bumpers 41. The presently preferred plastic is MARVALOY, manufactured by Marval Industries, Inc. of Mamaroneck, N.Y. MARVALOY has been found to be less brittle than styrene while having excellent clarity.

While several embodiments of the present invention have been disclosed, it is to be understood by those skilled in the art that other forms can be adopted, all coming within the spirit of the invention and scope of the appended claims:

We claim:

1. A retail bulk product dispenser comprising:

(a) a bin having a superior opening, a front wall, an opposing rear wall; at least two side walls connecting the front wall and opposing rear wall, a sloped floor forming an outlet, a baffle mounted against the front wall superior to the outlet, a parallel pair of facing transverse grooves in the side walls flanking the outlet, and a slot in the front wall aligned with the grooves;

(b) a hand operated dispensing mechanism, said dispensing mechanism comprising a gate slidably moveable between a normal, closed position and an open dispensing position, wherein the gate blocks the outlet when in its normal, closed position;

(c) said the gate having a forward handle, a rear end, at least two lateral sides; a medial opening, and a pair of runners disposed on the lateral sides of the gate, said runners being sized to fit within the transverse grooves;

(d) said gate being sized to pass through the slot;

(e) said gate being retained in and returned to its normal, closed position by a biasing means attached to the gate by a first fastener and attached to the opposing rear wall of the bin by a second fastener; and (f) a lid having an overlapping rim covering the superior opening.

2. A retail bulk product dispenser according to claim 1 wherein the medial opening of the gate has a width which extends substantially to each runner.

3. A retail bulk product dispenser according to claim 2 wherein the medial opening of the gate is shaped like a rectangle.

4. A retail bulk product dispenser according to claim 2 wherein the medial opening of the gate is substantially triangular in shape.

5. A retail bulk product dispenser according to claim 2 wherein the gate is further comprised of a plastic plate and a reinforcing plate, said plastic plate and reinforcing plate each having corresponding flanges and central openings which, when joined, form the runners of the gate and the medial opening of the gate, respectively.

6. A retail bulk product dispenser according to claim 5 wherein the plastic plate and the reinforcing plate are joined by at least one fastener, said fastener joining the plates outside of the bin such that the fastener never comes into contact with the product stored within the bin.

7. A retail bulk product dispenser according to claim 2 having a spout positioned under the outlet.

8. A retail bulk product dispenser according to claim 5 having a spout positioned under the outlet.

9. A retail bulk product dispenser according to claim 8 wherein:

(a) the transverse grooves have top edges and lower edges;

(b) the floor has an inferior end positioned flush with the top edges of the grooves;

(c) the slot has a lower edge;

(d) the spout has a front, a plurality of sides, and a rear side, wherein the front of the spout is positioned flush with the lower edge of the slot and the sides of the spout are positioned flush with the lower edges of the grooves;

(e) the rear side of the spout is offset rearwardly from the inferior end of the floor such that the floor overhangs the rear side of the spout;

(f) the rear side of the spout extends above the lower edges of the grooves such that it loosely contacts the gate;

(g) the medial opening of the gate has a rear edge;

(h) the medial opening of the gate also has a notch centrally located on the rear edge, said notch being sized relative to the amount of overhang between the inferior end of the floor and the rear side of the spout; and (i) wherein a fastener comprising a stopper screw and a nut joins the plastic plate and the reinforcing plate at the notch, said stopper screw preventing the rear edge of the medial opening from being pulled out from under the inferior end of the floor and preventing the gate from being pulled out of the slot.

10. A retail bulk product dispenser according to claim 1 wherein the floor has an upward angle ranging between 25° and 50°.

11. A retail bulk product dispenser according to claim 1 wherein the baffle has a downward angle ranging between 35° and 65°.

12. A retail bulk product dispenser according to claim 1 wherein the baffle is removably mounted by a mounting means.

13. A retail bulk product dispenser according to claim 1 having a shield affixed to the front wall such that the baffle is blocked from view.

14. A retail bulk product dispenser according to claim 13 wherein the shield comprises a product insert holder.

15. A retail bulk product dispenser according to claim 1 wherein the lid is affixed to said bin by a hinge.

16. A retail bulk product dispenser according to claim 15 wherein the hinge is a living hinge fabricated from a dual durometer plastic.

17. A retail bulk product dispenser according to claim 1 having a superior fluid receptacle, said fluid receptacle having at least one drain.

18. A retail bulk product dispenser according to claim 17 wherein the fluid receptacle has a crosspiece recessed within the fluid receptacle, said lid being affixed to said crosspiece by a hinge.

19. A retail bulk product dispenser according to claim 18 wherein the hinge is a living hinge fabricated from a dual durometer plastic.

20. A retail bulk product dispenser comprising:

(a) a bin having a superior opening, a front wall, an opposing rear wall, at least two side walls connecting the front wall and opposing rear wall, a sloped floor forming an outlet, said floor having an upward angle ranging between 25° and 50°, a baffle mounted against the front wall superior to the outlet, said baffle having a downward angle ranging between 35° and 65°, a parallel pair of facing transverse grooves in the side walls flanking the outlet, and a slot in the front wall aligned with the grooves;

(b) said baffle being removably mounted by a mounting means, a shield affixed to the front wall such that the baffle is blocked from view;

(c) a hand operated dispensing mechanism, said dispensing mechanism comprising a gate slidably moveable between a normal, closed position and an open dispensing position, wherein said gate blocks the outlet when in its normal, closed position;

(d) said gate having a forward handle, a rear end, at least two lateral sides, a medial opening, and a pair of runners disposed on the lateral sides of the gate, said runners being sized to fit within the grooves;

(e) said gate being sized to pass through the slot;

(f) said gate being retained in and returned to its normal, closed position by a biasing means attached to the gate and attached to a wall of the bin;

(g) said medial opening having a width which extends substantially to each runner;

(h) said gate further comprising a plastic plate and a reinforcing plate, said plastic plate and reinforcing plate each having corresponding flanges and central openings which, when joined, form the runners of the gate and the medial opening of the gate, respectively;

(i) said plastic plate and reinforcing plate being joined by at least one fastener, said fastener joining the plates outside of the bin such that the fastener never comes into contact with the product stored within the bin;

(j) a spout positioned under the outlet, said spout having a front, a plurality of sides, and a rear side;

(k) said transverse grooves having top edges and lower edges said floor having an inferior end positioned flush with the top edges of the grooves;

(l) said slot having a lower edge;

(m) said front of the spout being positioned flush with the lower edge of the slot;

(n) said sides of the spout being positioned flush with the lower edges of the grooves;

(o) said rear side of the spout being offset rearwardly from the inferior end of the floor such that the floor overhangs the rear side of the spout;

(p) said rear side of the spout extending above the lower edges of the grooves such that it loosely contacts the gate;

(q) said medial opening of the gate having a rear edge;

(r) said gate also having a detent located rear of the medial opening, said detent being sized relative to the amount of overhang between the inferior end of the floor and the rear side of the spout;

(s) wherein said detent prevents the rear edge of the medial opening from being pulled out from under the inferior end of the floor and prevents the gate from being pulled out of the slot;

(t) a superior fluid receptacle, said fluid receptacle having at least one drain and a crosspiece recessed within said fluid receptacle; and (u) a lid having an overlapping rim covering the superior opening, said lid being affixed to said crosspiece by a hinge, said hinge comprising a living hinge fabricated from a dual durometer plastic.

* * * * *